US005797812A

United States Patent [19]

Liu

[11] Patent Number: 5,797,812

[45] Date of Patent: Aug. 25, 1998

[54] SHOCK-ABSORBING STRUCTURES FOR RACKETS

[76] Inventor: Wen-Chung Liu, No. 3 Lane 125, Ren-Hua Road, Da-Li City, Taichung Hsien, Taiwan

[21] Appl. No.: 834,124

[22] Filed: Apr. 14, 1997

Related U.S. Application Data

[63] Continuation-in-part of Ser. No. 798,062, Feb. 11, 1997, abandoned.

[51] Int. Cl.[6] ..... A63B 49/00

[52] U.S. Cl. ..... 473/522; 473/521; 473/520

[58] Field of Search ..... 473/520, 521, 473/522

[56] References Cited

U.S. PATENT DOCUMENTS 5,096,194 3/1992 Yong et al. ..... 473/522

5,106,086 4/1992 Acosta ..... 473/522

5,350,173 9/1994 DiCerbo ..... 473/521

*Primary Examiner*—Raleigh W. Chiu

*Attorney, Agent, or Firm*—Morton J. Rosenberg; David I. Klein; Jun Y. Lee

[57] ABSTRACT

A shock-absorbing device for rackets includes a first clamping plate having at least one first hole defined therein and a second clamping plate having at least one hole defined therein. The first and second clamping plates are respectively mounted to two sides of a plurality of strings of a racket with the first hole aligning with the associated second hole. A retaining device extends through the first hole and the associated second hole for securely holding the first and the second clamping plates together.

12 Claims, 11 Drawing Sheets

SHOCK-ABSORBING STRUCTURES FOR RACKETS

CROSS-REFERENCES TO RELATED APPLICATION

This is a continuation-in-part application of U.S. patent application Ser. No. 08/798,062 filed on Feb. 11, 1997 now abandoned.

BACKGROUND OF THE INVENTION

1. Field of the Invention

The present invention relates to shock-absorbing structures which may reduce impact to the holder of the racket when hitting a ball.

2. Description of the Related Art

FIG. 11 of the drawings illustrates a racket frame 50 having a plurality of strings 51 extending therein, thereby forming a grid-like structure. When hitting a ball, the strings 51 exert an reactive force to the hand of the holder which may cause injury to the wrist and hand of the holder. In some conditions, the racket may fall if the reactive force is too strong to the holder. Accordingly, a shock-absorbing means has been heretofore provided to reduce the impact to the hand of the holder. As shown in FIGS. 10 and 11, the shock-absorbing means includes a flat body 60 having two notches 61 respectively defined in two sides thereof through which strings 51 extend.

Nevertheless, the engagement between the strings 51 and the notches 61 is not reliable such that the body 60 might be disengaged from the racket when subjected to a relatively large force. In addition, the shock-absorbing effect is poor since the body 60 can only hold two strings such that the vibrations of the strings are immediately transmitted after passing through the body 60. Furthermore, a considerable quantity of the bodies 60 are required for rackets having relatively large sweet spots as the body 60 can only hold two strings. The bodies 60 cannot be arranged in series and cannot mounted to cross strings.

Therefore, there has been a long and unfulfilled need for an improved shock-absorbing structure for rackets which mitigates and/or obviates the above problems.

SUMMARY OF THE INVENTION

A shock-absorbing device for rackets in accordance with the present invention comprises a first clamping plate having at least one first hole defined therein and a second clamping plate having at least one second hole defined therein. The first and second clamping plates are respectively mounted to two sides of a plurality of strings of a racket with the first hole aligning with the associated second hole. A retaining means extends through the first hole and the associated second hole for securely holding the first and the second clamping plates together. Preferably, the first clamping plate has a plurality of protrusions on a side thereof which faces the second clamping plate.

In an embodiment of the present invention, the retaining means includes a first retainer member extending through the second hole and a second retainer member extending through the first hole. The first retainer member includes a first recess defined therein and a first enlarged head. The second retainer member includes a second enlarged head on a first end thereof and a flange on a second end thereof. The flange is received in the first recess of the first retainer member and includes a second recess defined therein which aligns with the first recess. An elastic member is received in the first and the second recesses.

In another embodiment of the invention, the retaining means includes a first retainer member extending through the second hole and a second retainer member extending through the first hole. The first retainer member includes a first recess defined therein and a first enlarged head. The first retainer member further includes a plurality of radially spaced slots defined in a periphery thereof and a plurality of first notches defined in an end thereof which faces the second retainer member. The second retainer member includes a second enlarged head on a first end thereof and a flange on a second end thereof. The flange is received in the first recess of the first retainer member and includes a second recess defined therein which aligns with the first recess. The flange further includes a plurality of second notches defined in an end thereof, the second notches aligning with the first notches. The flange further includes a plurality of projections on an outer periphery thereof for engagement with the slots of the first retainer member. An elastic member is received in the first and the second recesses.

In still another embodiment of the present invention, the second clamping plate does not have holes defined therein, instead, the retaining means includes rivets or snap fasteners integrally formed on the second clamping plate which extend through the holes in the first clamping plate to securely engage the first and second clamping plates together.

Preferably, an insert is embedded in at least one of the first and second clamping plates. The shock-absorbing device may further comprise an elastic interconnecting member mounted between the first and second clamping plates.

Other objects, advantages, and novel features of the invention will become more apparent from the following detailed description when taken in conjunction with the accompanying drawings.

DESCRIPTION OF THE PREFERRED EMBODIMENTS

Figure 1:
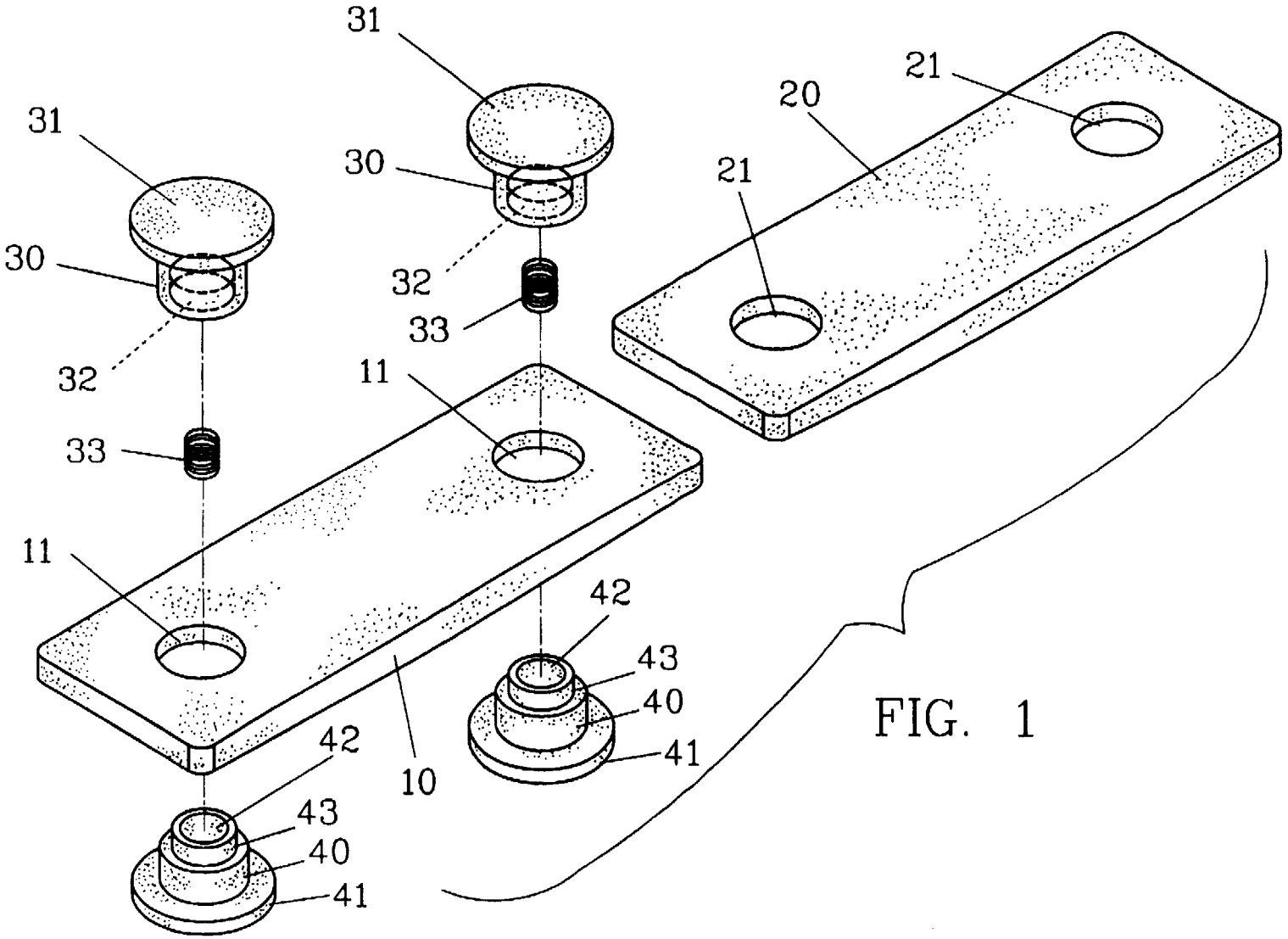
FIG. 1 is an exploded perspective view of an embodiment of a shock-absorbing device in accordance with the present invention.

Referring to FIGS. 1 to 9 and initially to FIG. 1, a shock-absorbing device in accordance with the present invention generally includes a first clamping plate 10 and a second clamping plate 20 which are respectively mounted to two sides of strings of a racket and which have a plurality of aligned holes 11, 21 therein. A retaining means is extended through each pair of the aligned holes 11 and 21. In this embodiment, the retaining means includes a first retainer member 30 extending through the hole 21 and a second retainer member 40 extending through the hole 11. The first retainer member 30 includes a first recess 32 defined therein and an enlarged head 31. The second retainer member 40 includes an enlarged head 41 on a first end thereof and a flange 43 on a second end thereof. The flange 43 is received in the first recess 32 of the first retainer member 30. Preferably, the first retainer member 30 and the second retainer member 40 are fittingly received in the hole 21 and the hole 11, respectively. An elastic member, e.g., a spring 33, may be received in the first recess 32 and a second recess 42 defined in the flange 43. The spring 33 may assist in the absorption of the shock when hitting a ball.

Figure 2:
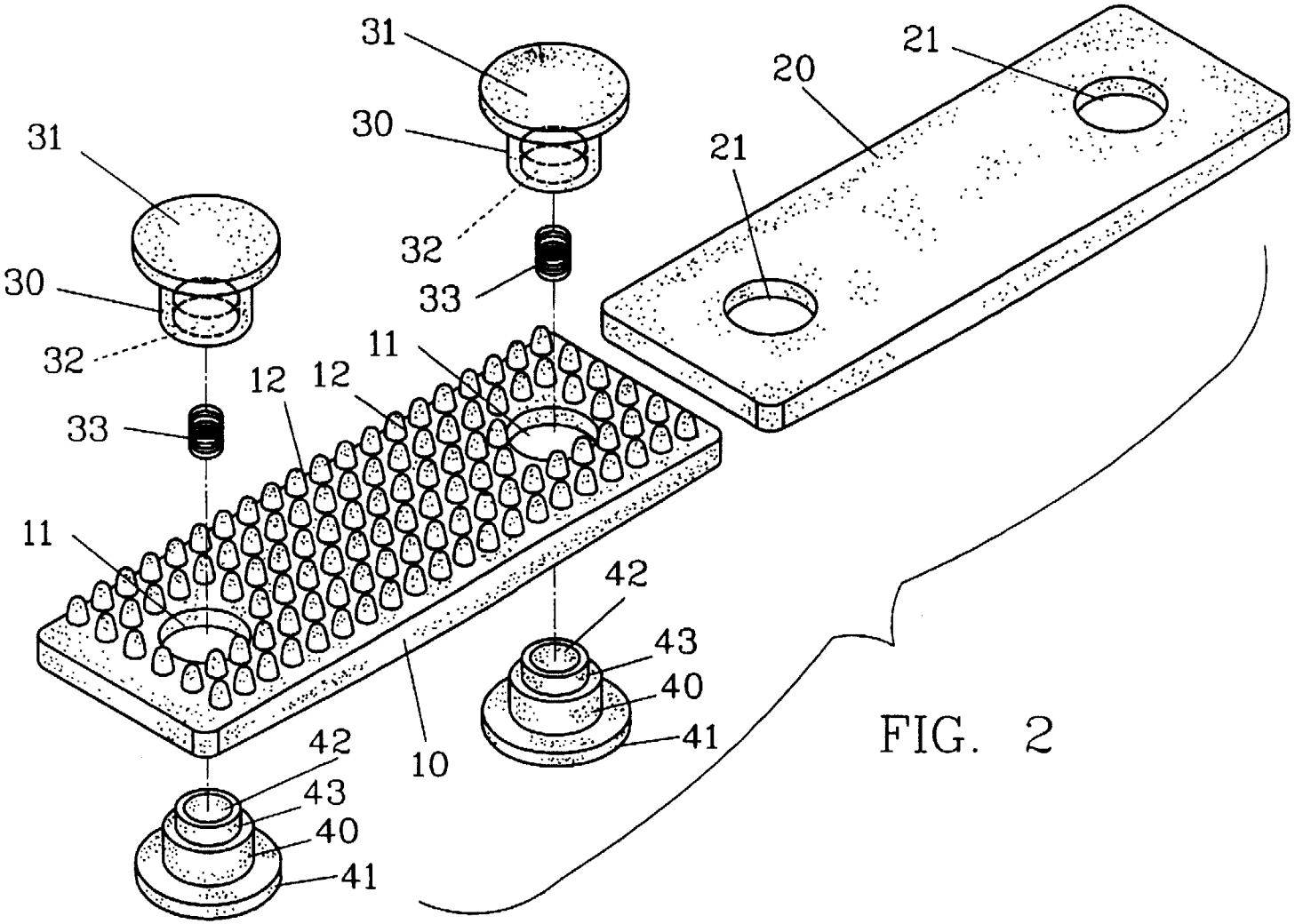
FIG. 2 is an exploded perspective view illustrating another embodiment of the shock-absorbing device in accordance with the present invention.
Figure 3:
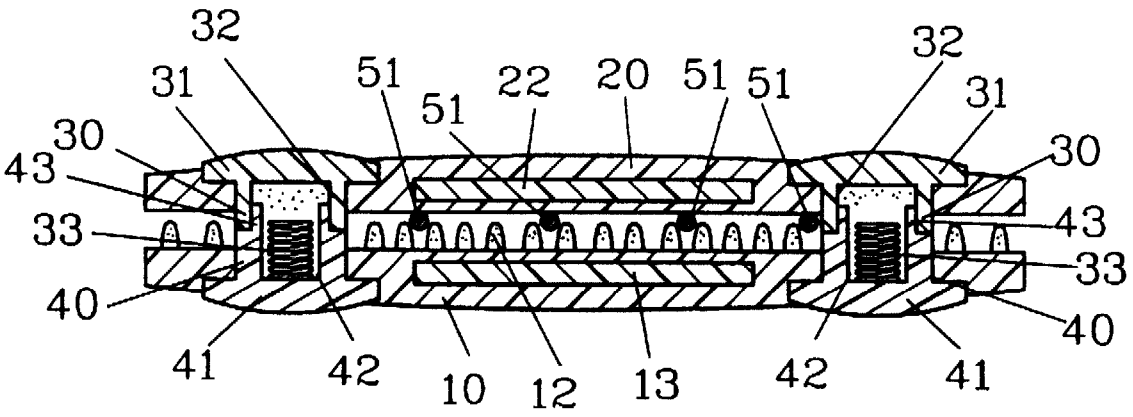
FIG. 3 is a cross sectional view of the shock-absorbing device in FIG. 2.

FIGS. 2 and 3 illustrate another embodiment of the invention, in which the first clamping plate 10 includes a plurality of protrusions 12 formed on a side thereof which faces the second clamping plate 20. The protrusions 12 may be in the form of ridges without adversely affecting the shock-absorbing function. As shown in FIG. 3, a first insert 13 and a second insert 22 may be respectively embedded in the first retainer member 10 and the second retainer member 20 to further assist in the absorption of the shock.

In assembly, still referring to FIGS. 2 and 3, the first and second clamping plates 10 and 20 are respectively mounted to two sides of the strings of the racket and thus hold a plurality of strings 51 while the holes 11 align with the associated holes 21. Then, the springs 33 are received in the associated recesses 32 of the first retainer member 30, and the first and second retainer members 30 and 40 are thereafter extended through the associated holes 21 and 11 in which the flanges 43 are received in the associated recesses 32, thereby securely holding the first and second clamping plates 10 and 20 together. The first and the second clamping plates 10 and 20 may be secured together by applying high-frequency welding to an interconnection section therebetween. When hitting a ball, the strings 51 vibrate, and such vibrations will be impeded by the protrusions 12.

The first and second clamping plates 10 and 20 may be securely held together by the retaining means without the risk of disengagement from the strings. In addition, the first and second clamping plates 10 and 20 may effectively hold the strings therebetween. The protrusions 12, the elastic members 33, and the inserts 13, 22 provide an excellent shock-absorbing effect. In addition, the first and second clamping plates 10 and 20 may hold a plurality of strings 51 therebetween such that it is not easy for the first and second clamping plates 10 and 20 to sway upon vibrations of the strings 51.

Figure 6:
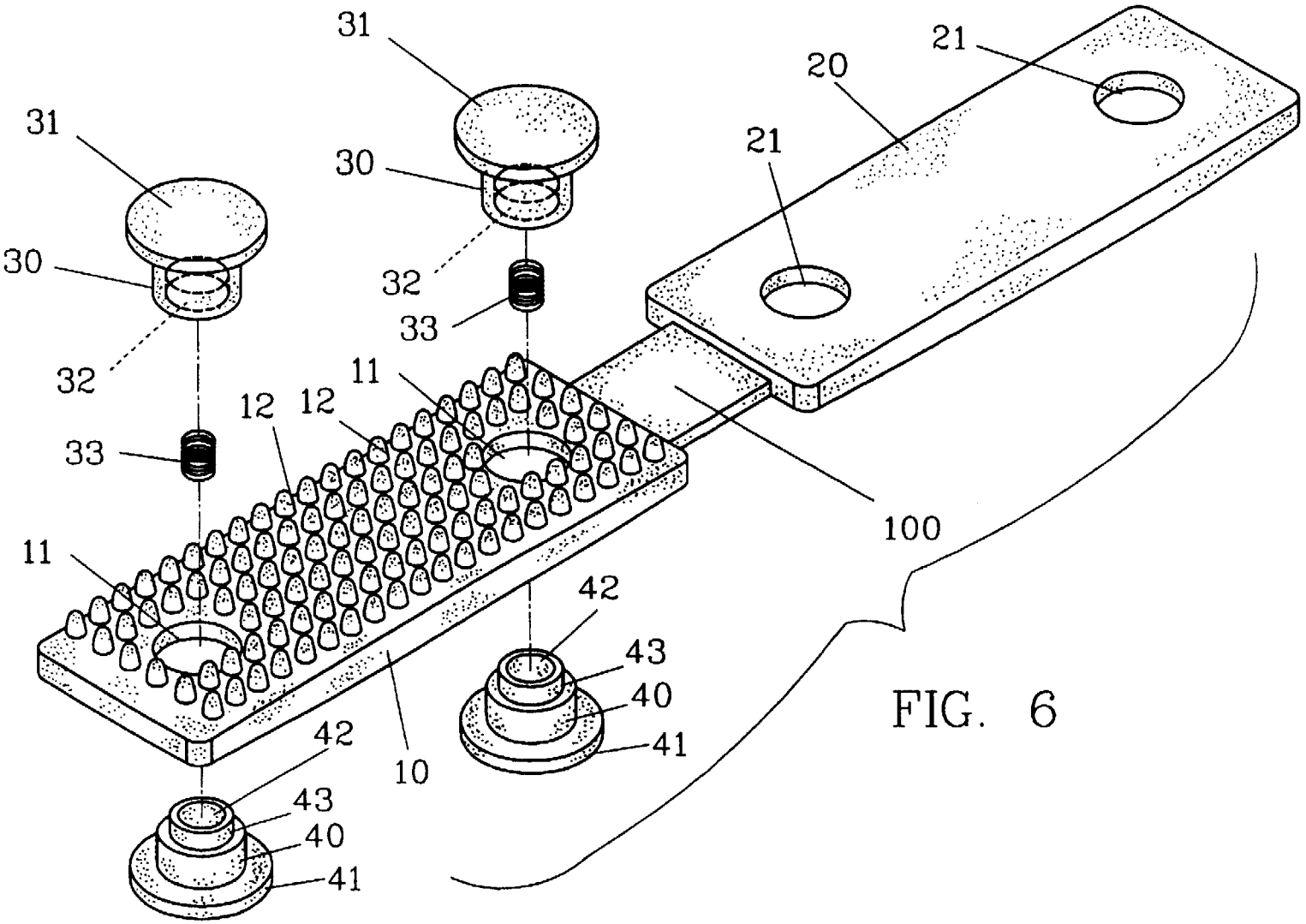
FIG. 6 is an exploded perspective view illustrating a further embodiment of the shock-absorbing device in accordance with the present invention.

In an embodiment of the invention, the first clamping plate 10 and the second clamping plate 20 may be interconnected via an interconnecting member 100, as shown in FIG. 6. This is advantageous in storage and package. Preferably, the connecting member 100 is elastic.

Figure 4:
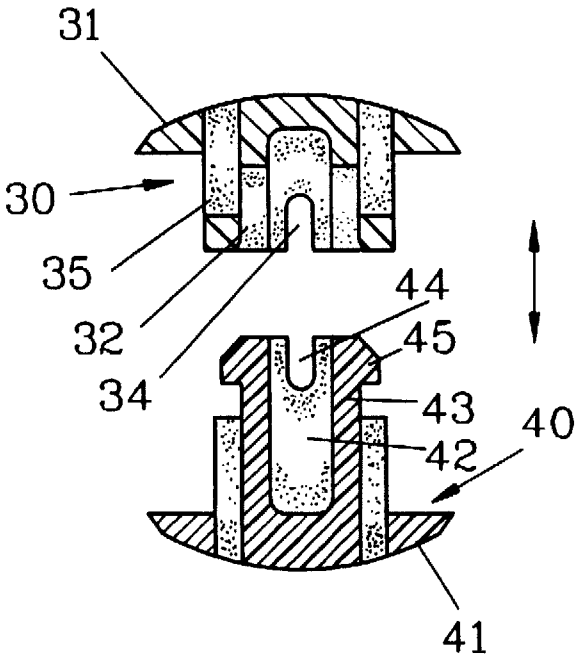
FIG. 4 is a cross sectional view illustrating another embodiment of a retaining means of the shock-absorbing device in accordance with the present invention.
Figure 5:
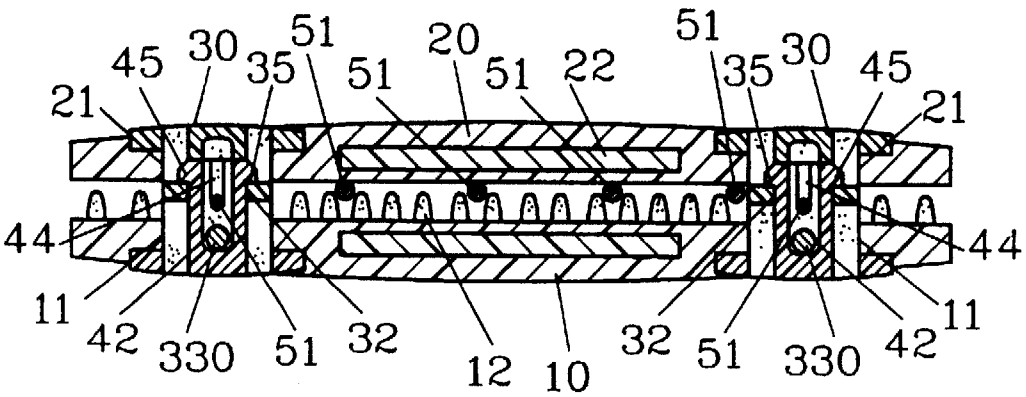
FIG. 5 is a cross sectional view illustrating a shock-absorbing device with the retaining means in FIG. 4.

Turning to FIGS. 4 and 5, in a further embodiment of the invention, the first retainer member 30 may include a plurality of radially spaced slots 35 defined in a periphery thereof and a plurality of notches 34 defined in an end thereof which faces the second retainer member. The flange 43 of the second retainer 40 may include a plurality of notches 44 aligning with the notches 34 of the first retainer member 30. In addition, the flange 43 may include a plurality of projections 45 on an outer periphery thereof for engagement with the slots 35 of the first retainer member 30.

In use, the first and second clamping plates 10 and 20 are mounted to two sides of strings 51 with the aligned holes 11 and 21 aligning with intersections of cross strings 51 (see the two outermost strings in FIG. 4). Elastic members 330 are received in the recesses 32 of the first retainer member 30. Then, the first and second retainer members 30 and 40 are respectively extended through the holes 21, 11 with the projections 45 received in the slots 35 and with the cross strings 51 (the two outermost strings) extending through the notches 34 and 44. This is advantageous in positioning of the first and second clamping plates 10 and 20, i.e., the first and second clamping plates 10 and 20 can be more reliably attached to the strings 51.

Figure 7:
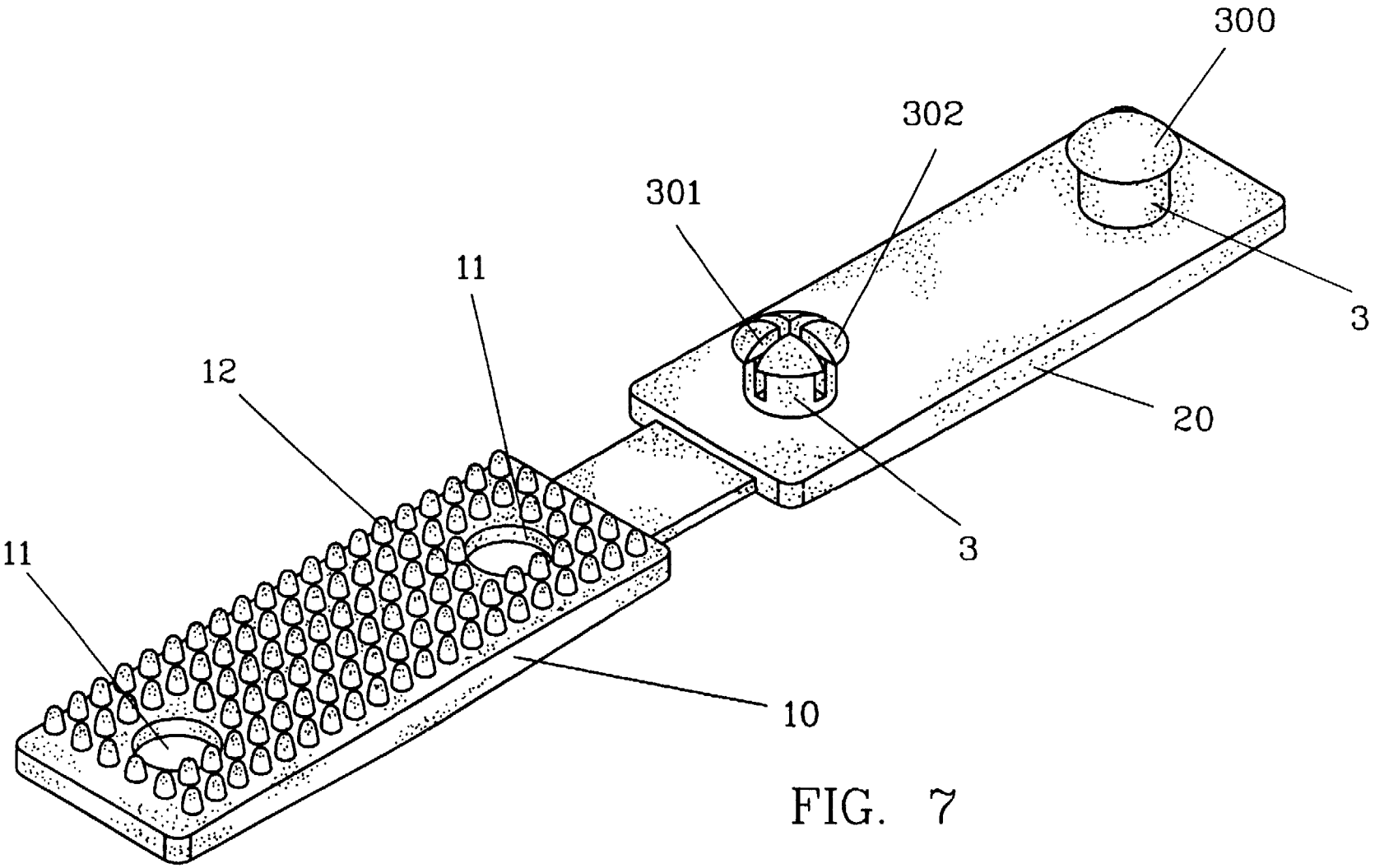
FIG. 7 is an exploded perspective view illustrating still another embodiment of the shock-absorbing device in accordance with the present invention.

FIG. 7 illustrates a further embodiment of the present invention, in which the second clamping plate 20 does not have holes defined therein, instead, the retaining means includes rivets 300 and/or snap fasteners 302 integrally formed on the second clamping plate 20. As shown in FIG. 7, the snap fastener 302 includes a cruciform notch 301 defined in a periphery thereof to assist in the assembly of the first and second clamping plates 10 and 20. The rivets 300 and/or snap fasteners 302 may extend through the holes 11 in the first clamping plate 10 to securely engage the first and second clamping plates 10 and 20 together.

Figure 8:
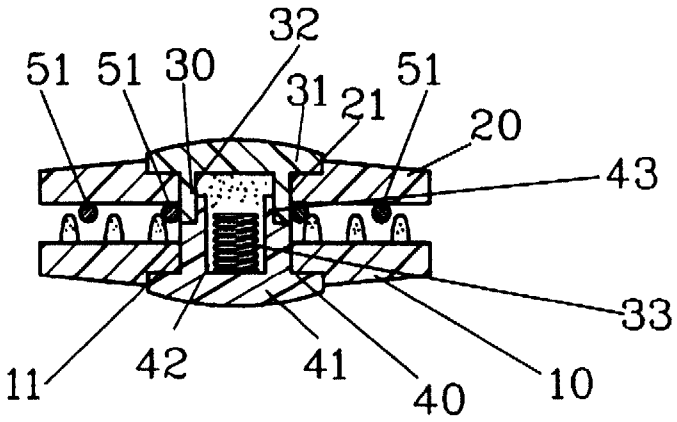
FIG. 8 is a cross sectional view of yet another embodiment of the shock-absorbing device in accordance with the present invention.
Figure 9:
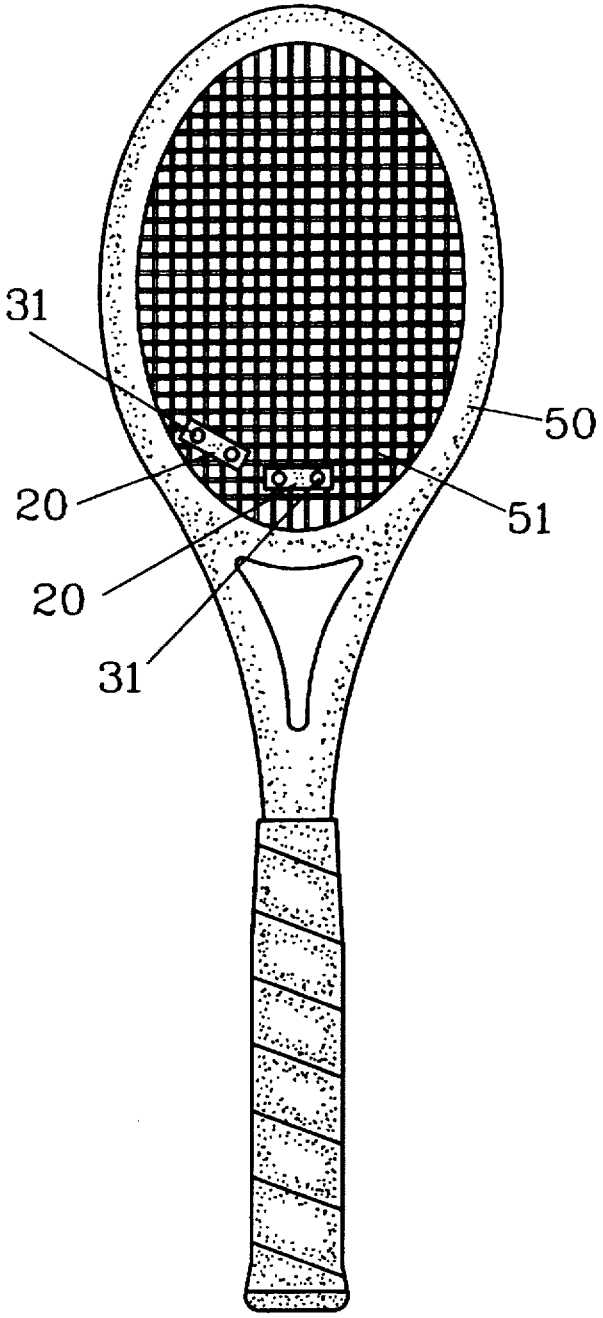
FIG. 9 is an elevational view of a racket having the shock-absorbing device in accordance with the present invention mounted thereon.
Figure 10:
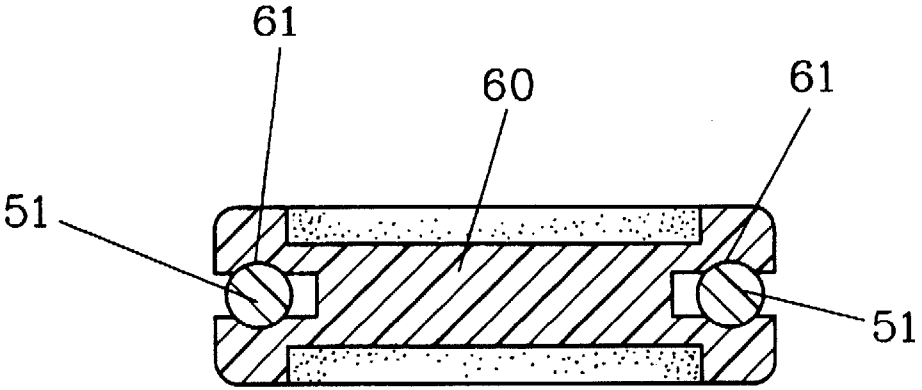
FIG. 10 PRIOR ART
FIG. 10 is a cross sectional view of a conventional shock-absorbing means.
Figure 11:
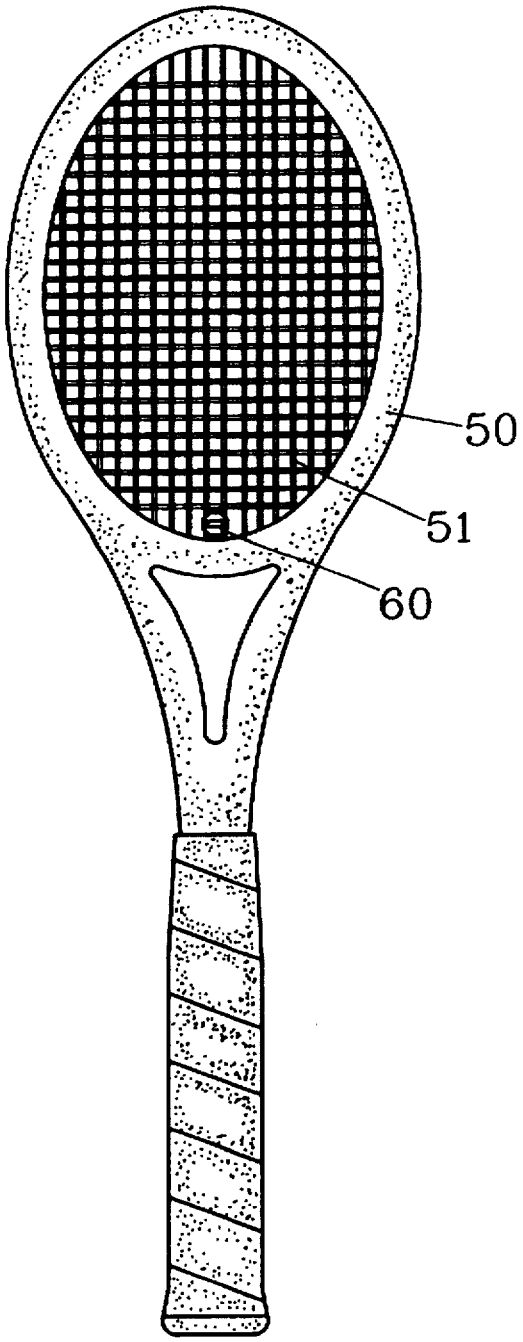
FIG. 11 PRIOR ART
FIG. 11 is an elevational view of a racket having the shock-absorbing means of FIG. 10 mounted thereon.

FIG. 8 illustrates still another embodiment of the invention, in which the first clamping plate 10 includes a single hole 11, and only one first retaining member 30 and only one second retaining member 40 are provided without adversely affecting the shock-absorbing function.

Although the invention has been explained in relation to its preferred embodiment, it is to be understood that many other possible modifications and variations can be made without departing from the spirit and scope of the invention as hereinafter claimed.

What is claimed is:

1. A shock absorbing assembly for a racket comprising:

(a) first and second clamping plates adapted for cooperatively capturing therebetween a plurality of strings of said racket, said first clamping plate having formed therein at least one first plate hole, said second clamping plate having formed therein at least one second plate hole, said first and second plate holes being aligned when said first and second clamping plates cooperatively capture said racket strings;

(b) retaining means coupled to said first and second plate holes of said first and second clamping plates for securing said first and second clamping plates about said racket strings; and, (c) resilient means adapted to be operably disposed substantially between said first and second clamping plates for resiliently dampening the vibration of said racket strings captured between said first and second clamping plates.

2. The shock absorbing assembly as recited in claim 1 wherein said resilient means includes a plurality of protrusions formed on said first clamping plate, said protrusions being disposed on said first clamping plate to extend toward said captured racket strings.

3. The shock absorbing assembly as recited in claim 1 wherein said retaining means includes:

(a) a first retainer member adapted to extend through said second plate hole, said first retainer member being formed with a first enlarged head portion and a first recess; and, (b) a second retainer member adapted to extend through said first plate hole for mated coupling with said first retainer member, said second retainer member having formed respectively at distal ends thereof a second enlarged head portion and a flange portion, said flange portion being adapted for insert into said first recess of said first retainer member and having formed therein a second recess, said first and second recesses defining a retainer compartment when said first and second retainer members are coupled together.

4. The shock absorbing assembly as recited in claim 3 wherein said resilient means includes a resilient member captured within said retainer compartment.

5. The shock absorbing assembly as recited in claim 1 wherein said retaining means includes:

(a) a first retainer member adapted to extend through said second plate hole, said first retainer member being formed with a first enlarged head portion and a body portion extending therefrom, said body portion having a first recess formed therein, said body portion terminating at an end portion and having formed thereat a plurality of first notches, said body portion having peripherally formed thereon a plurality of radially spaced slots; and, (b) a second retainer member adapted to extend through said first plate hole for mated coupling with said first retainer member, said second retainer member having formed respectively at distal ends thereof a second enlarged head portion and a flange portion, said flange portion being adapted for insert into said first recess of said first retainer member and having formed therein a second recess, said first and second recesses defining a retainer compartment when said first and second retainer members are coupled together, said flange portion having formed thereon a plurality of second notches adapted to align with said first notches and a plurality of radial projections adapted for engagement with said slots of said first retainer member body portion when said first and second retainer members are coupled together.

6. The shock absorbing assembly as recited in claim 5 wherein said resilient means includes a resilient member captured within said retainer compartment.

7. The shock absorbing assembly as recited in claim 1 further comprising a first insert member substantially embedded in said first clamping plate.

8. The shock absorbing assembly as recited in claim 7 further comprising a second insert member substantially embedded in said second clamping plate.

9. The shock absorbing assembly as recited in claim 1 wherein said first and second clamping plates are joined by a resilient interconnecting member coupled therebetween.

10. A shock-absorbing device for rackets, comprising:

a first clamping plate having at least one hole defined therein; and a second clamping plate having at least one rivet formed on a side thereof which faces the first clamping plate, the first and the second clamping plates being adapted to be respectively mounted to two sides of a plurality of strings of a racket with said at least one rivet extending through the associated hole.

11. A shock-absorbing device for rackets, comprising:

a first clamping plate having at least one hole defined therein; and a second clamping plate having at least one snap fastener formed on a side thereof which faces the first clamping plate, the first and the second clamping plates being adapted to be respectively mounted to two sides of a plurality of strings of a racket with said at least one snap fastener extending through the associated hole.

12. A shock-absorbing device according to claim 11, wherein said at least one snap fastener includes a cruciform notch defined therein.

* * * * *